US009175452B2

(12) United States Patent
Masloff et al.

(10) Patent No.: US 9,175,452 B2
(45) Date of Patent: Nov. 3, 2015

(54) SUBMERGED VOID FILLING

(75) Inventors: Brian P. Masloff, Westminster, CO (US); Richard Palladino, Evergreen, CO (US)

(73) Assignee: Cellular Concrete Solutions, LLC, Golden, CO (US)

( * ) Notice: Subject to any disclaimer, the term of this patent is extended or adjusted under 35 U.S.C. 154(b) by 0 days.

(21) Appl. No.: 13/370,373

(22) Filed: Feb. 10, 2012

(65) Prior Publication Data

US 2012/0207552 A1 Aug. 16, 2012

Related U.S. Application Data

(60) Provisional application No. 61/441,403, filed on Feb. 10, 2011.

(51) Int. Cl.
*E02D 3/12* (2006.01)
*E21B 43/28* (2006.01)

(52) U.S. Cl.
CPC .. *E02D 3/12* (2013.01); *E21B 43/28* (2013.01)

(58) Field of Classification Search
CPC ..... E02D 3/12; E21B 33/13; E21B 43/28; B65B 5/00
USPC ..... 405/129.45, 129.7, 129.85, 263, 267, 405/269; 299/4, 5; 166/285, 292, 295
See application file for complete search history.

(56) References Cited

U.S. PATENT DOCUMENTS 3,366,419 A * 1/1968 Pasternak et al. ..... 299/5
3,724,898 A * 4/1973 Jacoby ..... 299/5
4,007,964 A * 2/1977 Goldsmith ..... 299/4
4,191,254 A 3/1980 Baughman et al.
4,275,788 A * 6/1981 Sweatman ..... 166/292
4,466,833 A * 8/1984 Spangle ..... 106/602
4,744,700 A * 5/1988 Andy et al. ..... 405/264
4,919,822 A 4/1990 Boulanger
5,004,298 A 4/1991 Boulanger et al.
5,080,534 A 1/1992 Goodson et al.
5,310,282 A * 5/1994 Voskamp ..... 405/58
5,494,514 A 2/1996 Goodson et al.
5,776,243 A 7/1998 Goodson et al.
6,297,295 B1 10/2001 Gay et al.
6,695,543 B2 2/2004 Stephens (Continued)

OTHER PUBLICATIONS

Narayanan et al.; Structure and Properties of Aerated COncrete: A Review; Apr. 13, 2000.*

(Continued)

*Primary Examiner* — Benjamin Fiorello
(74) *Attorney, Agent, or Firm* — HolzerIPLaw, PC

(57) ABSTRACT

Systems and methods for filling submerged voids with a foam-fluidized fill material in an efficient and economical manner are disclosed herein. The foam fluidized fill material is a granular solid material fluidized with a foam. The foam-fluidized fill material is pumped or gravity-fed through an insertion tube into the submerged void. The insertion tube terminates at a point lying below a surface of the liquid within the void. Since the foam-fluidized fill material is heavier than the liquid, the foam-fluidized fill material exiting the insertion tube sinks to the bottom of the void and expands laterally at the bottom of the void displacing the liquid. The liquid is forced upward and out of the void where it may be collected. Further, as the fill material fills the void, the foam dissipates and the fill material self compacts, making the filled void sufficiently load bearing.

20 Claims, 7 Drawing Sheets

(56) References Cited

U.S. PATENT DOCUMENTS

| | | | | |
|---|---|---|---|---|
| 7,077,219 | B1 * | 7/2006 | Chatterji et al. | 175/66 |
| 7,645,097 | B2 * | 1/2010 | Canteri et al. | 405/267 |
| 2002/0015619 | A1 | 2/2002 | Stephens | |
| 2008/0205995 | A1 * | 8/2008 | Canteri et al. | 405/263 |
| 2009/0071376 | A1 | 3/2009 | Masloff et al. | |

OTHER PUBLICATIONS

International Searching Authority, U.S. Patent and Trademark Office; Written Opinion for PCT/US2012/024592, dated Feb. 10, 2012.

* cited by examiner

SUBMERGED VOID FILLING

CROSS-REFERENCE TO RELATED APPLICATIONS

The present application claims benefit of priority to U.S. Provisional Patent Application No. 61/441,403, entitled "Submerged Void Filling" and filed on Feb. 10, 2011, which is specifically incorporated by reference herein for all that it discloses or teaches.

BACKGROUND

Many mining, excavation, and/or construction projects involve the removal of large amount of material beneath a ground surface, which results in underground cavities or voids. For example, an underground mining operation may remove a quantity of ore-bearing rock from an underground geological formation leaving one or more voids in the formation. These underground voids may be or become unstable and risk collapse of the ground above, causing injury to personnel and/or damage to equipment resting on the ground above the void. Further, a variety of natural phenomenon may also cause underground cavities or voids, which also can unexpectedly collapse.

In order to prevent and/or reduce the risk of collapse, known underground voids that are or are expected to be unstable may be filled with a solid material. Typically, this is accomplished by mixing a fluid or semi-fluid slurry of aggregate material and fines (e.g., cement or fly ash) and/or water together and pumping and/or gravity feeding the slurry through one or more injection points into the underground void until it is filled with the slurry. The slurry is then expected to cure and withstand loads from the ground surface above without or with a lower risk of collapsing.

However, hydraulic placement of the slurry mixture consumes large quantities of water that may be expensive and/or not be readily available at the location of the submerged void and may require a high-energy pump to maintain a sufficient flow rate to keep the slurry mixed until placed within the submerged void. Further, underground voids are often filled or semi-filled with water or other liquid. This may be due to the underground voids lying below an applicable water table for the underground void location, for example. Conventional void filling technologies are not particularly effective at displacing the water or other liquids in the void while simultaneously filling the void with the slurry mixture. For example, the slurry mixture may largely distribute within the water upon impact with the liquid surface and/or the slurry mixture may separate upon contact with the water surface (e.g., the cementious particles may largely float while the aggregate materials sink). As a result, the void may not be effectively filled with the slurry (e.g., it may have an inconsistent compressive strength due to a non-homogeneous composition of the deposited slurry mixture), thus much of the slurry mixture may be forced back up through a point of injection, and/or the slurry may not distribute horizontally within the void very effectively, thus limiting the maximum horizontal spacing of injection points.

As a result, current systems and methods for filling submerged voids or cavities are often expensive to implement and often fail to produce a desired performance in the field. This is often due to segregation of constituent materials of a filling material and resistance of the filling material to move through water-filled cavities.

SUMMARY

Implementations described and claimed herein address the foregoing problems by injecting a foam-fluidized fill material into a void at an injection point beneath a surface of a liquid within the void, wherein the foam-fluidized fill material is injected at a velocity sufficient for the foam-fluidized fill material to expand laterally within the void and displace the liquid.

Other implementations described and claimed herein address the foregoing problems by drilling a hole from a surface to access the submerged void; inserting an injection tube from the surface and through the hole, wherein a distal end of the injection tube extends beneath a surface of a liquid within the submerged void; and injecting a foam-fluidized fill material with a density greater than that of the liquid into the submerged void through the injection tube at a velocity sufficient for the foam-fluidized fill material to expand laterally and displace the liquid.

Still other implementations described and claimed herein address the foregoing problems by calculating a maximum hole spacing for filling a submerged void; drilling two or more holes from a surface to access the submerged void, wherein the holes are spaced no further apart than the calculated maximum hole spacing; inserting an injection tube from the surface and through each of the holes, wherein a distal end of each of the injection tubes extends beneath a surface of a liquid within the submerged void; and injecting a foam-fluidized fill material with a density greater than that of the liquid into the submerged void through the injection tubes at a velocity sufficient for the foam-fluidized fill material to expand laterally and displace the liquid.

Other implementations are also described and recited herein.

BRIEF DESCRIPTIONS OF THE DRAWINGS

DETAILED DESCRIPTIONS

Figure 1:
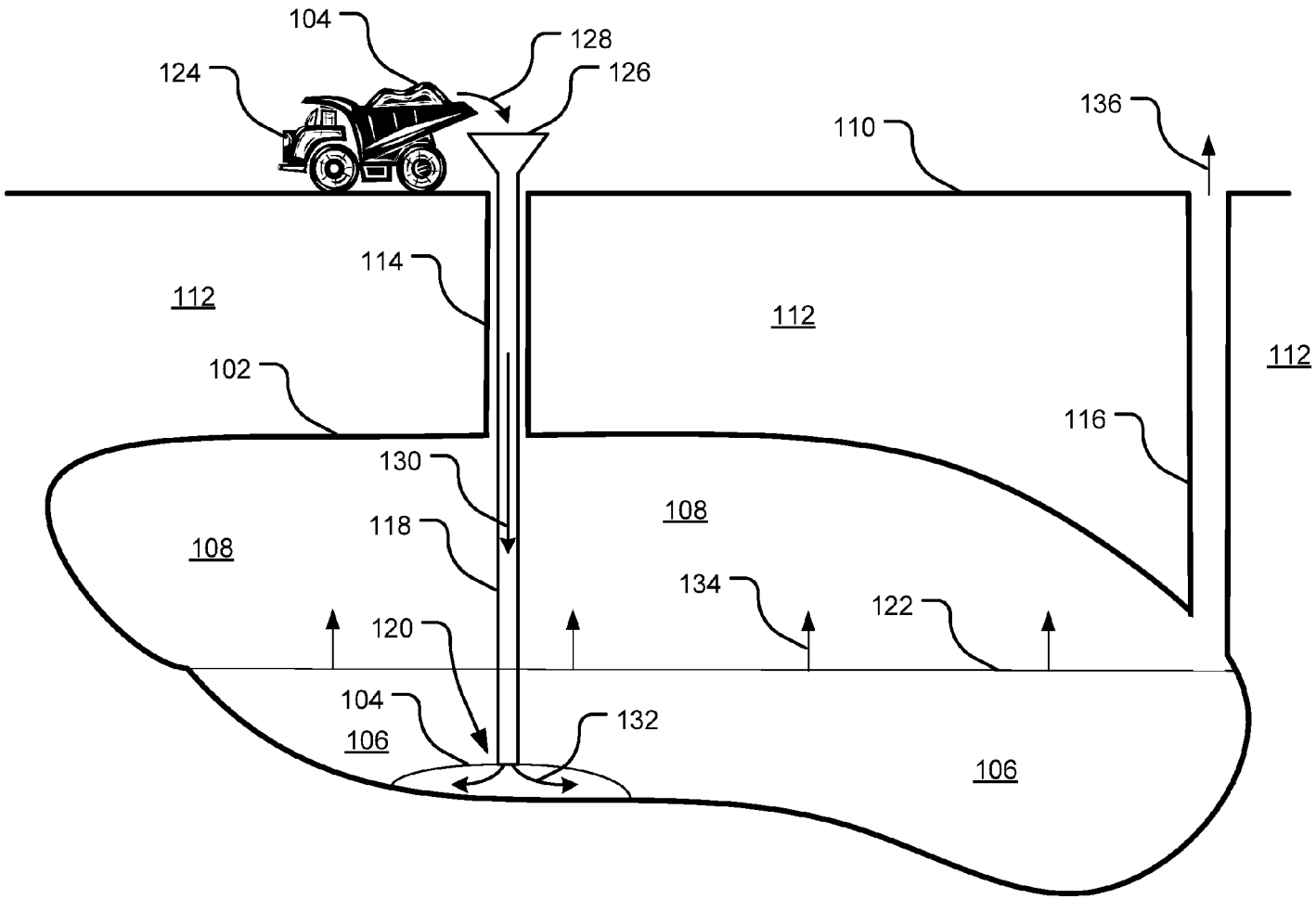
FIG. 1 illustrates an example submerged void in a first stage of filling with a foam-fluidized fill material.

FIG. 1 illustrates an example submerged void 102 in a first stage of filling with a foam-fluidized fill material 104. The submerged void 102 (or cavity) is an enclosed or partially enclosed volume that is at least partially filled with a liquid 106 (e.g., water and/or oil) with the remainder of the submerged void 102 filled with a gas 108 (e.g., air). Other implementations may have multiple layers of liquids and/or gasses within the submerged void 102 (see e.g., FIG. 6). The submerged void 102 may be located immediately beneath a ground surface 110 (i.e., underground) or at variety of depths within earth 112. While the submerged void 102 is described and depicted herein as underground, the presently disclosed technology is equally applicable to submerged voids that are above ground (e.g., within a storage tank). The submerged void 102 may have a variety of shapes and sizes and the interior walls of the submerged void 102 may be fluid pervious semi-pervious, or impervious. In many implementations, the interior walls of the submerged void 102 are composed or rock and/or other earthen materials. The submerged void 102 may be naturally occurring (e.g., a geological formation) or fabricated (e.g., an underground mine).

In order to access the interior of the submerged void 102, one or more holes (e.g., holes 114, 116) may be drilled or otherwise punctured from the ground surface 110, through the earth 112 to the submerged void 102. The holes may be preexisting from other operations involving the submerged void 102 (e.g., wells, testing ports, and/or naturally occurring cracks or fissures) or created specifically for filling the submerged void 102. An injection tube 118 (e.g., a tremie tube) is inserted through the hole 114 into the submerged void 102. The injection tube 118 may be rigid or flexible depending on the application and be constructed of a variety of materials (e.g., metallic alloys and plastics). A distal end 120 of the injection tube 118 extends below a surface 122 of the liquid 106 within the submerged void 102 and terminates above the bottom of the submerged void 102.

Feeding the foam-fluidized fill material 104 down the injection tube 118 into the submerged void 102 fills the submerged void 102. The foam-fluidized fill material 104 is a granular solid material (e.g., sand, fill dirt, and/or industrial process waste materials) fluidized with a foam. The specific gravity of the fill material 104 is greater than the specific gravity of the liquid 106. As a result, the fill material 104 settles to the bottom of the submerged void 102 rather than floating on top of the liquid 106 within the submerged void 102.

In some implementations, the solid material is of a consistent gradation ranging from 2 inch to 300 mesh. The solid material may be selected to allow natural drainage of water through the placed fill material 104. Sand fill material constituents (as opposed to cementious fill materials) typically have greater permeability characteristics. Permeability testing, along with gradation analysis can be performed on a proposed solid material to determine if modifications should be made to the proposed solid material in order to achieve the desired drainage characteristics of a filled void.

In one implementation, the solid material is mixed with a concentrate foaming agent (e.g., a liquid or powder concentrate surfactant) to simultaneously generate the foam via shear action with the solid material and mix the foam with the solid material. In another implementation, the foam is generated separate from the solid material and then mixed with the solid material. For example, the foam may be generated by agitating 1 part foaming agent with 50 parts water. The mixing may be accomplished by traditional batching methods (e.g., drum or paddle mixers) or by continuation mixing (e.g., volumetric mixer or pug mill), for example. Characteristics of each of the solid material (e.g., type, density, gradation) and the foam (e.g., stiffness, air content, surfactant content, and dissipation rate), as well as the relative concentrations of solid material and foam within the fill material 104, may be optimized for the specific conditions of the submerged void 102. A relatively homogenous, fluid-like, and pumpable mixture results when the solid fill material and the foam are mixed together. In one implementation, the fill material 104 weighs approximately 80 pounds per cubic foot.

In one implementation, the foam is a surfactant diluted with water. Such surfactants can be commercially available products (e.g., various blends of cationic, nonionic, anionic, protein-based, and/or any other surfactant capable of generating bubbles). A surfactant may be selected based on temperature, acidity/basicity, particle size, and specific gravity of the foamed matrix created using the surfactant. The selected surfactant determines the cell size of the foam matrix. The dilute surfactant may be pumped through a foam generator to create a stiff foam. In some implementations, the foam weights between 1.5 and 2.5 pounds per cubic foot. The foam can be a dense thick foam at 10 pounds per cubic foot or a light foam at 0.5 pounds per cubic foot depending on the application. For example, a thick, dense foam may hold course and/or heavy materials in suspension better than a thin, light foam. The thin, light foam may move horizontally through the submerged void 102 better than the thick dense foam. The amount of foam added to the fill material 104 is variable over a wide range and depends upon desired performance characteristics. In one implementation, the minimum amount of foam capable of transporting the fill material 104 in a fluid-like mixture is 10-50% of the total of the fill material by volume.

The fill material 104 may be prepared at the site where the submerged void 102 is located or remotely prepared and transported to the submerged void 102 site. In an example gravity-fed implementation, a dump truck 124 or other material moving machine may dump the fill material 104 into a hopper 126 that feeds the fill material 104 into the injection tube 118 (as evidenced by arrow 128). The fill material 104 then continues down the injection tube 118 by the force of gravity (as evidenced by arrow 130). The fill material 104 is then discharged from the injection tube 118 below the liquid surface 122 and begins to flow outward along the bottom surface of the submerged void 102 (as evidenced by arrow 132). In other implementations, the fill material 102 is pressure-driven through the injection tube 118 via a pump (see e.g., pump 544 of FIG. 5).

In an example implementation, the fill material 104 flows roughly 35 feet laterally at the bottom of the submerged void 102. For comparison purposes, the solid fill material within the fill material 104, but without the foam may be expected to flow only roughly 12 feet laterally. The foam-fluidization of the fill material 104 can be expected to at least double the lateral flow distance of similar non-fluidized fill material. Discharging the fill material 104 below the liquid surface 122 reduces or prevents the foam from rapidly separating from the solid material, which would normally occur upon impact with the liquid surface 122 if the fill material 104 is discharged from the injection tube 118 above the liquid surface 122.

As the fill material 104 begins to fill the submerged void 102, it displaces the liquid 106 within the submerged void 102, forcing the liquid surface 122 upward (as evidenced by arrow 134). As the liquid surface 122 rises, the gas 108 is displaced, forcing the gas out of the submerged void 102. For example, the gas 108 may exit the submerged void 102 via the hole 116 (as evidenced by arrow 136). The gas 108 may also exit via the hole 114 or directly through the walls of the submerged void 102 if the walls are pervious or semi-pervious.

Figure 2:
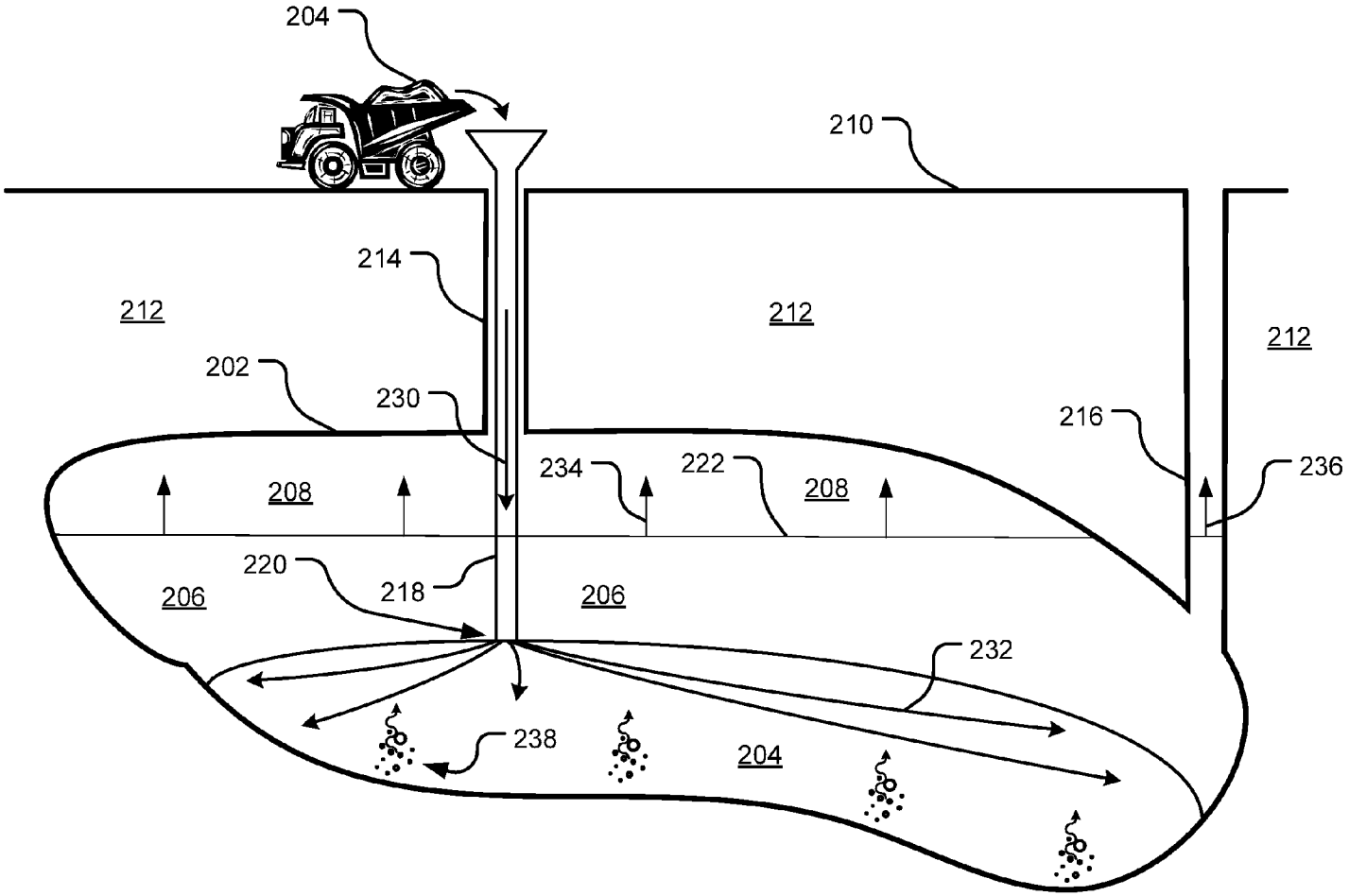
FIG. 2 illustrates an example submerged void in a second stage of filling with a foam-fluidized fill material.

FIG. 2 illustrates an example submerged void 202 in a second stage of filling with a foam-fluidized fill material 204. The submerged void 202 is partially filled with the fill material 204, at least partially filled with a liquid 206, with the remainder of the submerged void 202 filled with a gas 208. One or more holes (e.g., holes 214, 216) may be drilled or otherwise punctured from a ground surface 210, through earth 212 to the submerged void 202. An injection tube 218 is inserted through the hole 214 into the submerged void 202. A distal end 220 of the injection tube 218 extends below a surface 222 of the liquid 206 within the submerged void 202 and terminates above the bottom of the submerged void 202.

Feeding the foam-fluidized fill material 204 down the injection tube 218 into the submerged void 202 fills the submerged void 202. The foam-fluidized fill material 204 is a granular solid material fluidized with a foam. The specific gravity of the fill material 204 is greater than the specific gravity of the liquid 206. As a result, the fill material 204 settles to the bottom of the submerged void 202 rather than floating on top of the liquid 206 within the submerged void 202. The fill material 204 is fed down the injection tube 218 by the force of gravity (as evidenced by arrow 230) and discharged from the injection tube 218 below liquid surface 222 and flows outward at the bottom of the submerged void 202 (e.g., see arrow 232).

As compared to the first stage of filling illustrated by FIG. 1, the second stage of filling illustrated by FIG. 2 depicts that as the fill material 204 further fills the submerged void 202, it displaces more liquid 206 within the submerged void 202, forcing the liquid surface 222 further upward (as evidenced by arrow 234) and into the hole 216 (as evidenced by arrow 236). As the liquid surface 222 rises further, more gas 208 is displaced, forcing more gas 208 out of the submerged void 202. For example, the gas 208 may exit the submerged void 202 via the hole 216. The gas 208 may also exit via the hole 214 or directly through the walls of the submerged void 202 if the walls are pervious or semi-pervious. Further, if any of the gas 208 is trapped within the submerged void 202 (e.g., because the submerged void 202 is non pervious, the hole 214 is sealed, and the hole 216 is blocked by the liquid 206 as depicted in FIG. 2), the liquid 206 is forced out of the submerged void 202 via hole 216 and the trapped gas 208 remains within the submerged void 202.

As the fill material 204 is placed within the submerged void 202, the injection tube 218 may be withdrawn, so long as the distal end 220 of the injection tube 218 remains below the liquid surface 222. Withdrawing the injection tube 218 while placing the fill material 204 decreases the pressure required to force the fill material 204 down the injection tube 218. In a gravity-fed implementation, the injection tube 218 may be withdrawn when the flow rate of the fill material 204 drops below a predetermined rate or stops completely.

Further, as the fill material 204 is placed within the submerged void 202, the foam breaks down over time and air bubbles (e.g., bubbles 238) within the foam-fluidized fill material 204 dissipate out of the fill material 204 and permeate upward through the fill material 204 and join with the gas 208 and/or exit the submerged void 202 via one or both of the holes 214, 216 or directly through the walls of the submerged void 202 if the walls are pervious or semi-pervious. The bubbles permeate upward because their relative specific gravity is less than the specific gravity of the liquid 206. Further, the solid material within the fill material 204 gravitates downward to displace space left by the bubbles as they permeate upwards, and as a result, the fill material 204 self-compacts.

As the foam breaks down and air bubbles are released from the fill material 204, the fill material 204 becomes less fluid and more solid and then the relative density of the fill material 204 increases. This limits the distance horizontally that the fill material 204 travels within the submerged void 202. As a result, lower layers of the fill material 204 are more solid because more time has elapsed since placement of the lower layers and more air bubbles have dissipated out of the lower layers. Therefore, upper layers of fill material 204 largely move across the top of the stabilized lower layers of the fill material 204 as they are placed within the submerged void 202. The rate at which the foam breaks down over time and the air bubbles are released from the fill material 204 may be optimized for the specific characteristics of the submerged void 202 that is being filled.

In one implementation, the placed fill material 204 may have a minimum density equal to 70% of the fill material 204 maximum standard proctor value. The standard proctor value is used in testing the compaction of soils in the construction materials testing industry (CMT) and includes taking a sample of soil, adding moisture and compacting this material to its maximum density (and resulting maximum dry density) so there is the minimum amount of air voids in the soil, which would allow future consolidation from future loading. This process minimizes potential consolidation during wet and dry cycles. The maximum dry density will have the highest bearing capacity. The moisture content of the soil associated with the maximum dry density is called the optimum moisture content. The optimum moisture content allows the soil to compact under a hammer and mold procedure. The type of fines and quantity of fines within the fill material will vary since clay soils react with moisture differently than silt soils. For example, an optimum moisture content for a silt-sand can be in the range of 7 to 10 percent, a clay-sand can have an optimum moisture content in the 20 percent range. Submerged conditions influence the penetration tests. The fill material 204 may be selected to provide the maximum amount of solids at the bottom of the submerged void 202 that will push the liquid upward, while being dense enough to carry a load at the surface 210 above the submerged void 202.

Figure 3:
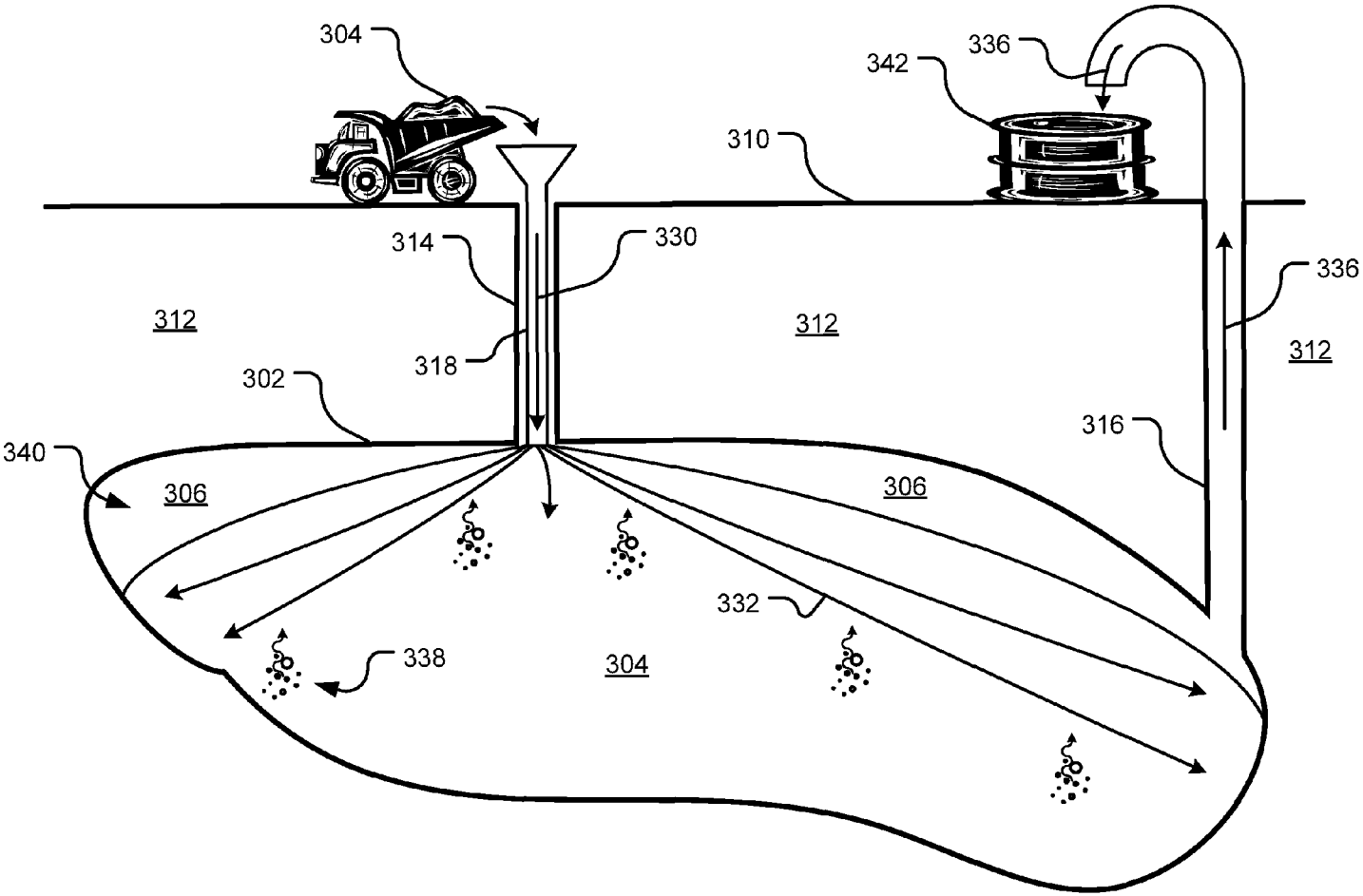
FIG. 3 illustrates an example submerged void in a third stage of filling with a foam-fluidized fill material.

FIG. 3 illustrates an example submerged void 302 in a third stage of filling with a foam-fluidized fill material 304. The submerged void 302 is partially filled with the fill material 304 with the remainder of the submerged void 302 filled with a liquid 306. One or more holes (e.g., holes 314, 316) may be drilled or otherwise punctured from a ground surface 310, through earth 312 to the submerged void 302. An injection tube 318 is inserted through the hole 314 and terminates at a top of the submerged void 302.

Feeding the foam-fluidized fill material 304 down the injection tube 318 into the submerged void 302 fills the submerged void 302. The foam-fluidized fill material 304 is a granular solid material fluidized with a foam. The specific gravity of the fill material 304 is greater than the specific gravity of the liquid 306. As a result, the fill material 304 settles to the bottom of the submerged void 302 rather than floating in the liquid 306 within the submerged void 302. The fill material 304 is fed down the injection tube 318 by the force of gravity (as evidenced by arrow 330), discharged from the injection tube 318, and flows outward mostly at the top of previously placed fill material 304 (e.g., see arrow 332).

As compared to the second stage of filling illustrated by FIG. 2, the third stage of filling illustrated by FIG. 3 depicts that as the fill material 304 mostly fills the submerged void 302 and displaces most all gases (if there were any to begin with) and more liquid 306 within the submerged void 302. The fill material 304 forces the liquid 306 through and out of the hole 316 (as evidenced by arrows 336) into a storage tank 342. In other implementations, the liquid 306 may be discharged into a reservoir (not shown) or merely discharged onto the ground 310. The liquid 306 may also exit via the hole 314 or directly through the walls of the submerged void 302 if the walls are pervious or semi-pervious. Further, if any pockets (e.g., pocket 340) of the liquid 306 or gas (not shown) are trapped within the submerged void 302 (e.g., because the submerged void 302 is non pervious, the hole 314 is sealed, and the hole 316 is blocked by the fill material 304 as depicted in FIG. 3), the pocket(s) may be allowed to remain in the submerged void 302 if insignificant in size or they may be filled using an additional hole or holes (see e.g., FIG. 5).

As the fill material 304 is placed within the submerged void 302, the injection tube 318 may be further withdrawn up to the entrance of the submerged void 302 (as depicted in FIG. 3), or higher in some implementations. Withdrawing the injection tube 318 while placing the fill material 304 decreases the pressure required to force the fill material 304 down the injection tube 318. In a gravity-fed implementation, the injection tube 318 may be withdrawn when the flow rate of the fill material 304 drops below a predetermined rate or stops completely.

Further, as the fill material 304 is placed within the submerged void 302, the foam breaks down over time and air bubbles (e.g., bubbles 338) within the foam-fluidized fill material 304 dissipate out of the fill material 304 and permeate upward through the fill material 304 and exit the submerged void 302 via one or both of the holes 314, 316 or directly through the walls of the submerged void 302 if the walls are pervious or semi-pervious. Further, the solid material within the fill material 304 gravitates downward to displace space left by the bubbles as they permeate upwards, and as a result, the fill material 304 self-compacts.

As the foam breaks down and air bubbles are released from the fill material 304, the fill material 304 becomes less fluid and more solid and then the relative density of the fill material 304 increases. This limits the distance horizontally that the fill material 304 travels within the submerged void 302. As a result, lower layers of the fill material 304 are more solid because more time has elapsed since placement of the lower layers and more air bubbles have dissipated out of the lower layers. Therefore, upper layers of the fill material 304 largely move across the top of the stabilized lower layers of the fill material 304 as they are placed within the submerged void 302.

Figure 4:
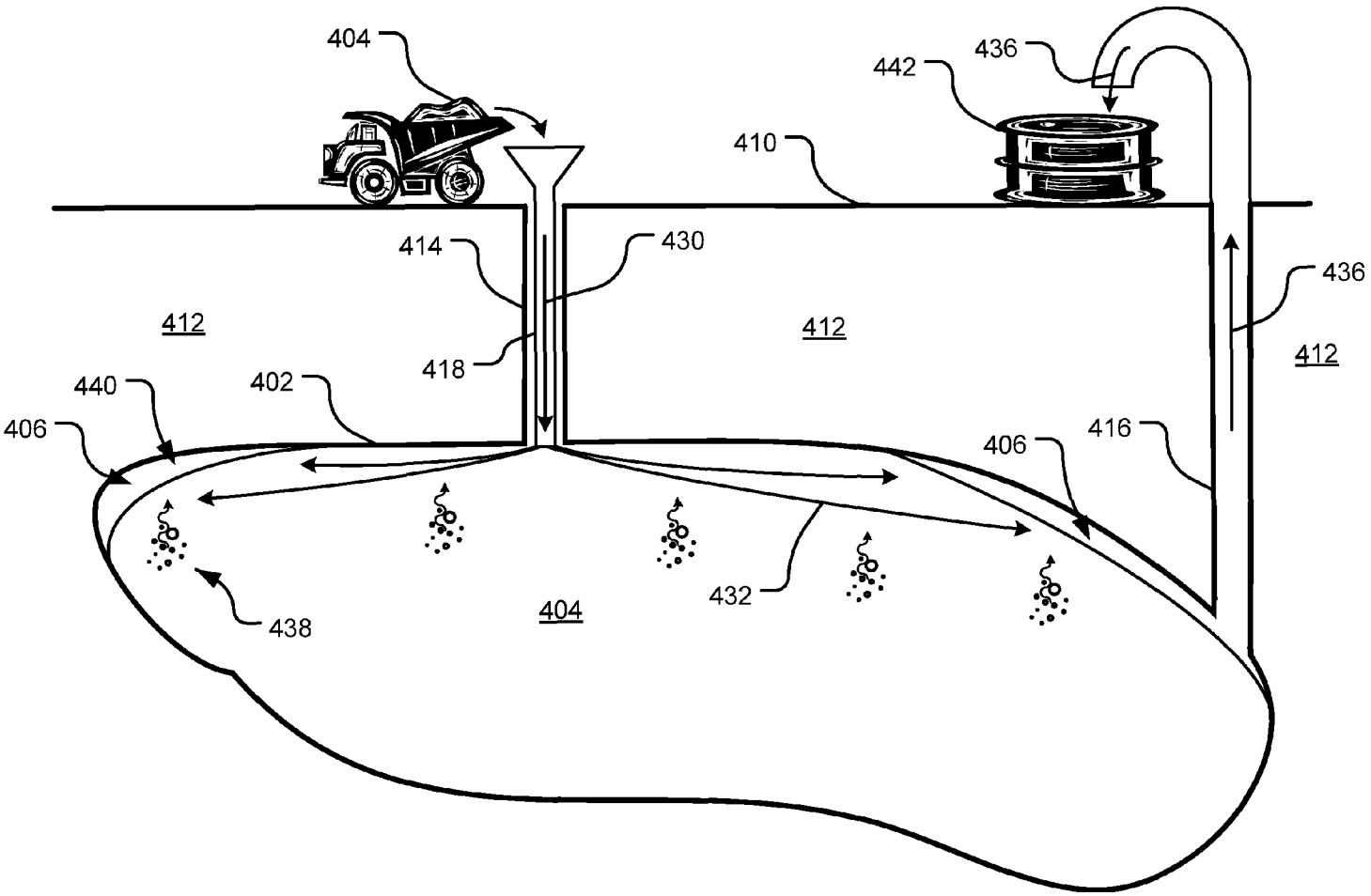
FIG. 4 illustrates an example submerged void in a fourth stage of filling with a foam-fluidized fill material.

FIG. 4 illustrates an example submerged void 402 in a fourth stage of filling with a foam-fluidized fill material 404. The submerged void 402 is mostly filled with the fill material 404 with the remainder of the submerged void 402 filled with a liquid 406. One or more holes (e.g., holes 414, 416) may be drilled or otherwise punctured from a ground surface 410, through earth 412 to the submerged void 402. An injection tube 418 is inserted through the hole 414 and terminates at a top of the submerged void 402.

Feeding the foam-fluidized fill material 404 down the injection tube 418 into the submerged void 402 fills the submerged void 402. The foam-fluidized fill material 404 is a granular solid material fluidized with a foam. The specific gravity of the fill material 404 is greater than the specific gravity of the liquid 406. As a result, the fill material 404 settles to the bottom of the submerged void 402 rather than floating in the liquid 406 within the submerged void 402. The fill material 404 is fed down the injection tube 418 by the force of gravity (as evidenced by arrow 430), discharged from the injection tube 418, and flows outward mostly at the top of previously placed fill material 404 (e.g., see arrow 432).

As compared to the third stage of filling illustrated by FIG. 3, the fourth stage of filling illustrated by FIG. 4 depicts that as the fill material 404 almost completely fills the submerged void 402 and displaces most all gases (if there were any to begin with) and most of the liquid 406 within the submerged void 402. The fill material 404 forces the liquid 406 through and out of the hole 416 (as evidenced by arrows 436) into a storage tank 442. The liquid 406 may also exit via the hole 414 or directly through the walls of the submerged void 402 if the walls are pervious or semi-pervious. The fill material 404 may continue to be added to the submerged void 402 until it stops flowing into the submerged void 402 and/or starts flowing back out of the submerged void 402 (e.g., via hole 416). If one or more pockets (e.g., pocket 440) of the liquid 406 or gas (not shown) remain trapped within the submerged void 402 after the fill material 404 stops flowing into the submerged void 402 (or starts flowing back out of the submerged void 402), the pockets of the liquid 406 or gas may be allowed to remain in the submerged void 402 if insignificant in size or extracted from the submerged void 402 using an additional hole or holes (see e.g., FIG. 5).

As the fill material 404 is placed within the submerged void 402, the foam breaks down over time and air bubbles (e.g., bubbles 438) within the foam-fluidized fill material 404 dissipate out of the fill material 404 and permeate upward through the fill material 404 and exit the submerged void 402 via one or both of the holes 414, 416 or directly through the walls of the submerged void 402 if the walls are pervious or semi-pervious. Further, the solid material within the fill material 404 gravitates downward to displace space left by the bubbles as they permeate upwards, and as a result, the fill material 404 self-compacts.

As the foam breaks down and air bubbles are released from the fill material 404, the fill material 404 becomes less fluid and more solid and then the relative density of the fill material 404 increases. This limits the distance horizontally that the fill material 404 travels within the submerged void 402. As a result, lower layers of the fill material 404 are more solid because more time has elapsed since placement of the lower layers and more air bubbles have dissipated out of the lower layers. Therefore, upper layers of fill material 404 largely move across the top of the stabilized lower layers of the fill material 404 as they are placed within the submerged void 402.

The placed fill material 404 may be designed to achieve its load carrying capacity without traditional compaction methods (e.g., vibratory rollers) because additional compaction may not be available within the submerged void 402. One way of measuring the load carrying capacity of the placed fill material 404 is to drill into the placed fill material 404 and apply a downward load to the fill material 404 to measure the resistance of the fill material 404 to the load.

Figure 5:
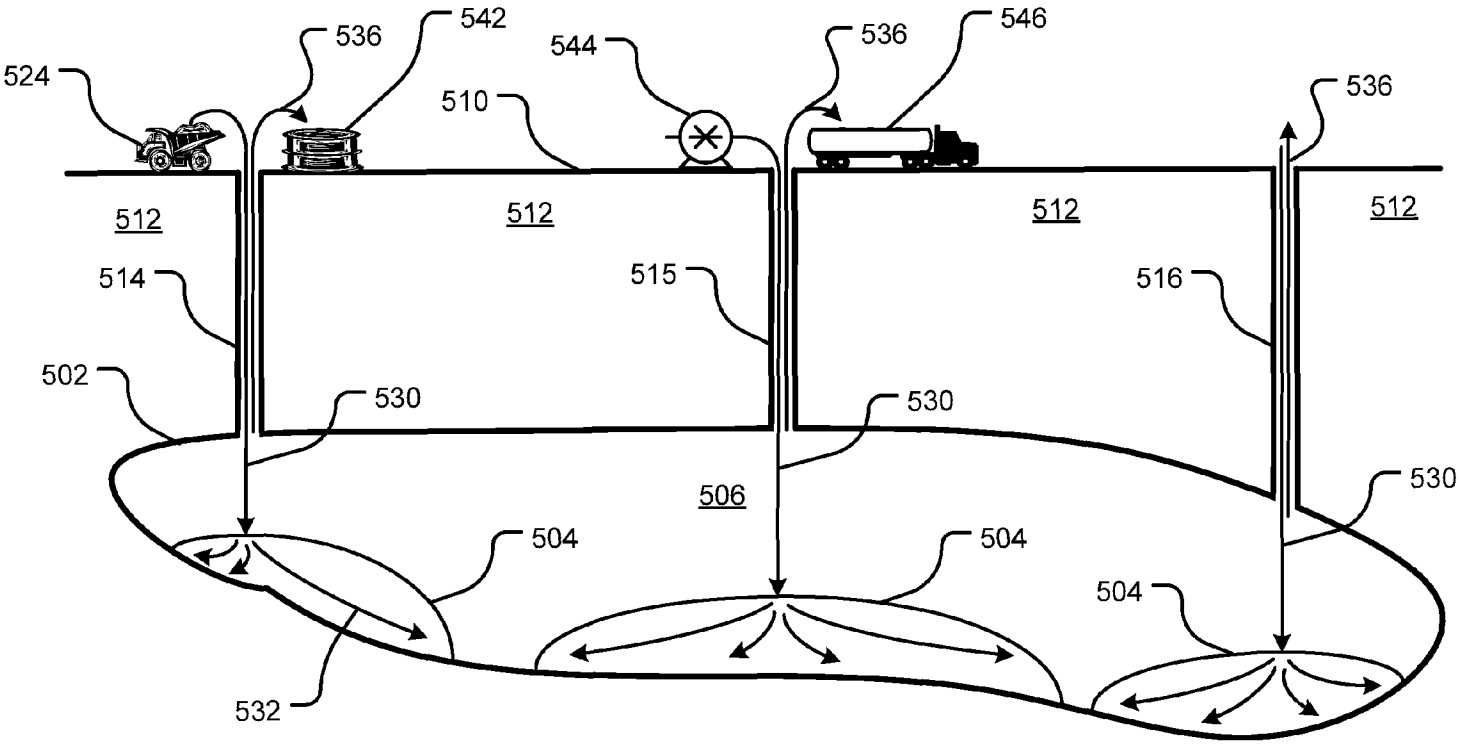
FIG. 5 illustrates an example submerged void being filled with a foam-fluidized fill material using multiple injection points.

FIG. 5 illustrates an example submerged void 502 being filled with a foam-fluidized fill material 504 using multiple injection holes 514, 515, 516. In a particularly large submerged void 502, multiple injection holes 514, 515, 516 are used to adequately fill the large submerged void 502 with the fill material 504. While FIG. 5 illustrates three example injection holes 514, 515, 516, greater or fewer injection holes may be used as determined appropriate for the characteristics of the submerged void 502.

The submerged void 502 is partially filled with the fill material 504, at least partially filled with a liquid 506, with the remainder of the submerged void 502 is filled with a gas (not shown). The holes 514, 515, 516 may be drilled or otherwise punctured from a ground surface 510, through earth 512 to the submerged void 502. Feeding the foam-fluidized fill material 504 through the holes 514, 515, 516 into the submerged void 502 (e.g., via injection tubes (see FIGS. 1-4)) fills the submerged void 502. For example, at hole 514, a dump truck 524 or other material moving machine dumps the fill material 504 into a hopper that gravity-feeds into an injection tube that leads to the submerged void 502. In another example at hole 515, a pump 544 pumps the foam-fluidized fill material 504 through the injection tube that leads to the submerged void 502. Other methods of feeding the fill material 504 through the injection tubes are contemplated herein.

The foam-fluidized fill material 504 is a granular solid material fluidized with a foam. The specific gravity of the fill material 504 is greater than the specific gravity of the liquid 506. As a result, the fill material 504 settles to the bottom of the submerged void 502 rather than floating within the liquid 506 in the submerged void 502. The fill material 504 is fed down the holes 514, 515, 516 (as evidenced by arrows 530) and discharged from the injection tubes below the liquid surface 506. The fill material 504 flows laterally outward from each of the injection tubes at the bottom of the submerged void 502 (e.g., see arrow 532).

As the fill material 504 fills the submerged void 502, it displaces the liquid 506 within the submerged void 502, forcing the liquid 506 upward and out of one or more of the holes 514, 515, 516 (as evidenced by arrows 536). For example, the liquid 506 is forced out of hole 514 and deposited into a storage tank 542. In a further example, liquid 506 is forced out of hole 515 and deposited into a tanker truck 546. In other implementations, the liquid 306 may be discharged into a reservoir (not shown), merely discharged onto the ground 310, or otherwise stored or discarded. The liquid 506 may also exit the submerged void 502 directly through the walls of the submerged void 502 if the walls are pervious or semi-pervious.

As the fill material 504 is placed within the submerged void 502, the injection tube may be gradually withdrawn. Withdrawing the injection tube 518 while placing the fill material 504 decreases the pressure required to force the fill material 504 down the injection tube. In a gravity-fed implementation (e.g., at hole 514), the injection tube may be withdrawn an incremental predetermined distance when the flow rate of the fill material 504 drops below a predetermined rate or stops completely.

In a pressure-driven implementation (e.g., at hole 515), a pressure gauge (not shown) may be mounted on the injection tube that monitors pressure within the injection tube. For example, if the pressure within the injection tube rises above a predetermined level, the injection tube is withdrawn an incremental predetermined distance, causing the pressure within the tube to drop. Once the pressure within the injection tube again rises above the predetermined level, the injection tube is again withdrawn the incremental predetermined distance. This process repeats until no amount of withdrawing the injection tube causes the pressure to drop below the predetermined level. Further, the pressure may be monitored to determine when the submerged void 502 is full (e.g., by monitoring for a spike in the pressure).

Figure 6:
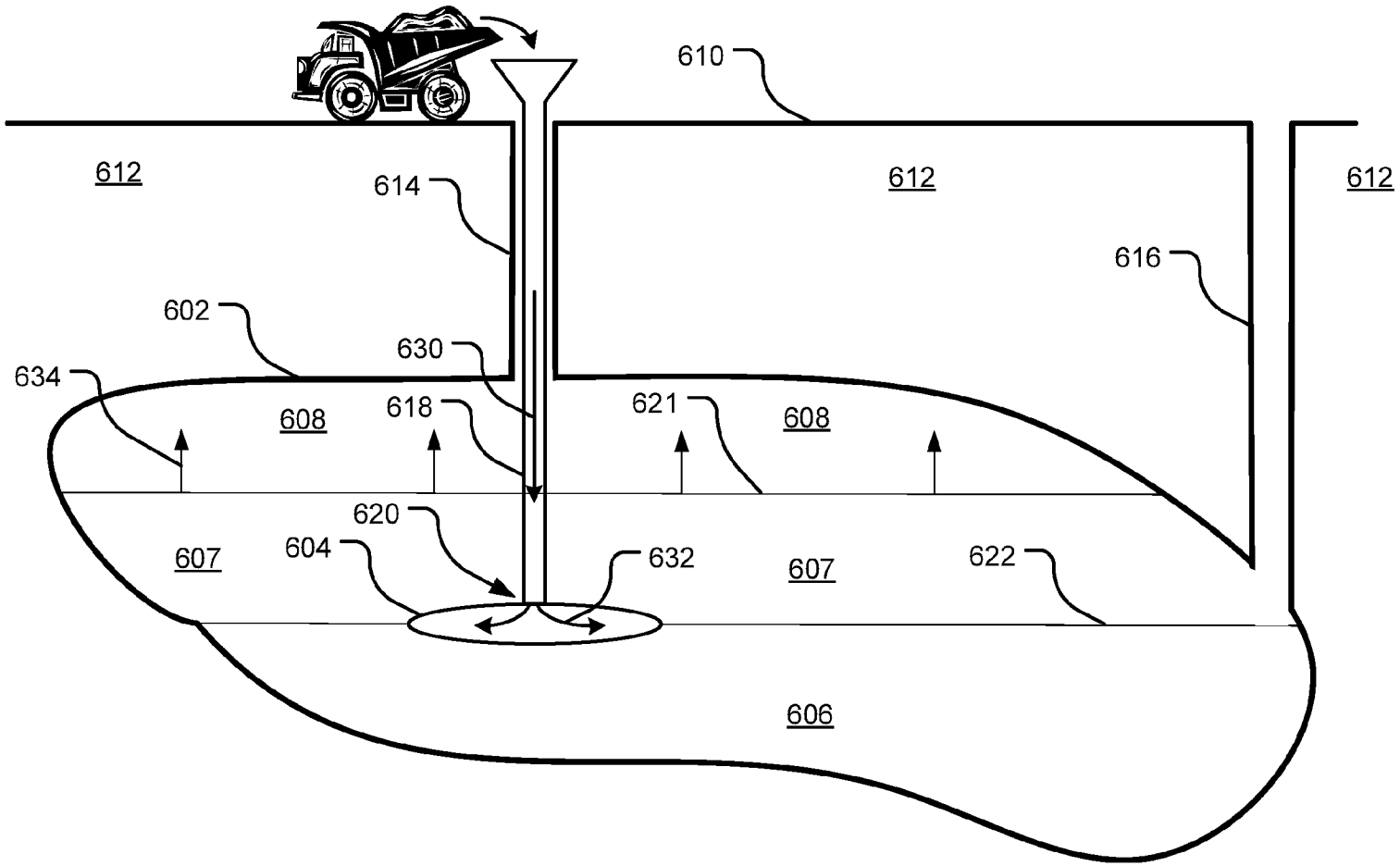
FIG. 6 illustrates an example submerged void being filled with a foam-fluidized fill material separating a first liquid from a second liquid.

FIG. 6 illustrates an example submerged void 602 being filled with a foam-fluidized fill material 604 separating a first liquid 606 from a second liquid 607. The submerged void 602 is filled with the first liquid 606, the second liquid 607, and a gas 608. The liquids 606, 607 and gas 608 are separated in layers due to their differing specific gravities or densities. More specifically, the first liquid 606 is heavier than the second liquid 607 and the second liquid 607 is heavier than the gas 608.

In order to access the interior of the submerged void 602, one or more holes (e.g., holes 614, 616) may be drilled or otherwise punctured from the ground surface 610, through the earth 612 to the submerged void 602. An injection tube 618 is inserted through the hole 614 into the submerged void 102. A distal end 620 of the injection tube 618 extends below a surface 621 of the second liquid 607 within the submerged void 602 and terminates above a surface 622 of the first liquid 606.

Feeding the foam-fluidized fill material 604 down the injection tube 618 into the submerged void 602 fills the submerged void 602. The foam-fluidized fill material 604 is a granular solid material fluidized with a foam. The specific gravity of the fill material 604 (even after the foam dissipates) is less than the specific gravity of the liquid 606, but greater than the specific gravity of the liquid 607. As a result, the fill material 604 settles between the liquids 606, 607.

The fill material 604 is fed down the injection tube 618 by the force of gravity (as evidenced by arrow 630). The fill material 604 is then discharged from the injection tube 618 between the liquids 606, 607 and begins to form an expanding pocket (as evidenced by arrow 632). In other implementations, the fill material 602 is pressure-driven through the injection tube 618 via a pump (see e.g., pump 544 of FIG. 5). As the fill material 604 fills the submerged void 602, it displaces the liquid 607 within the submerged void 602, forcing the liquid surface 621 upward (as evidenced by arrow 634). As the liquid surface 621 rises, the gas 608 is displaced, forcing the gas 608 out of the submerged void 602. As the fill material 604 further fills the submerged void 602, the liquids 606, 607 may become completely isolated from one another. Further, liquid 606 may be extracted from the submerged void 602 (e.g., via hole 616) while leaving liquid 607 in place.

Figure 7:
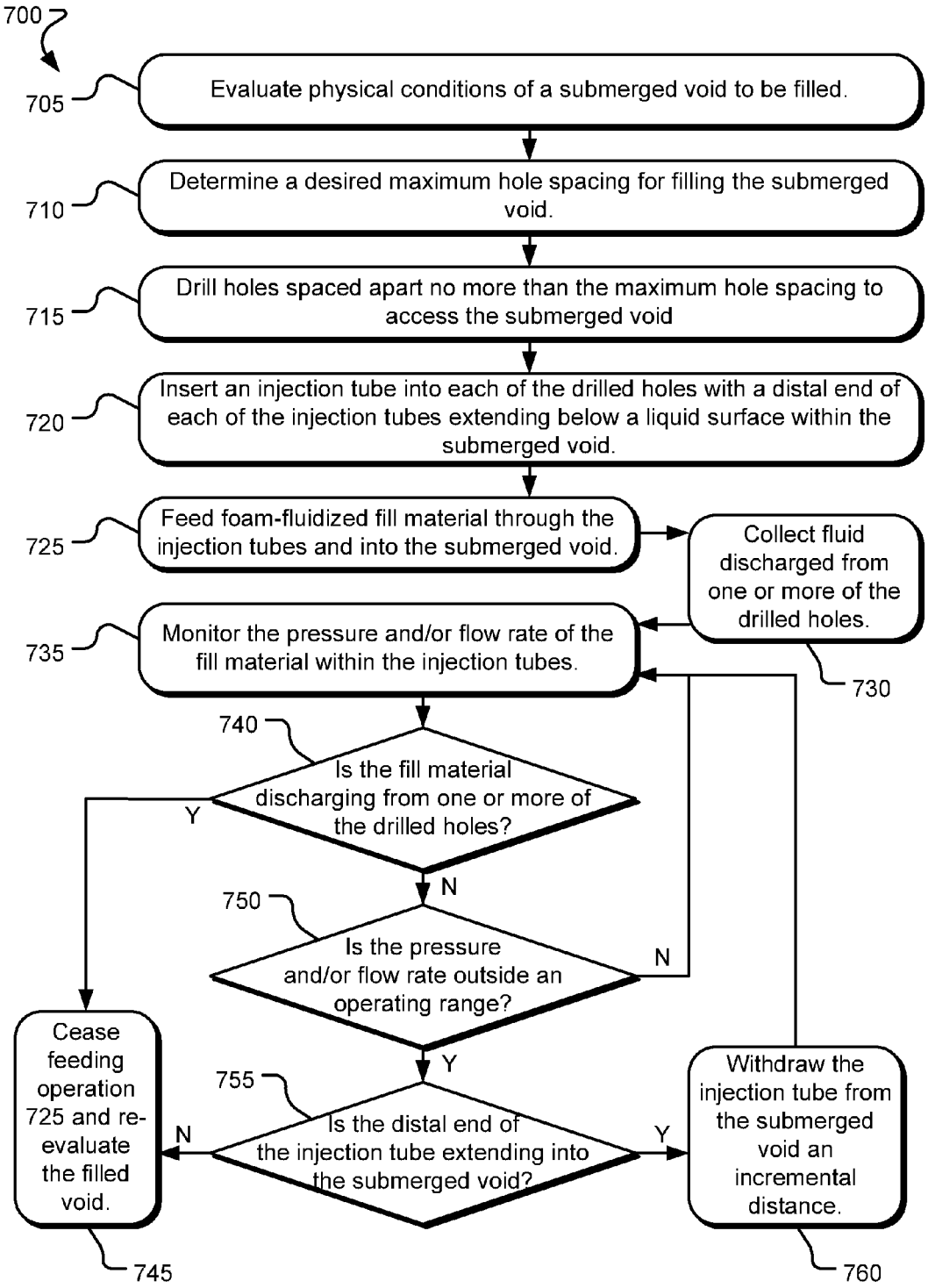
FIG. 7 illustrates example operations for filling a submerged void using a foam-fluidized fill material.

FIG. 7 illustrates example operations 700 for filling a submerged void using a foam-fluidized fill material. An evaluation operation 705 evaluates physical conditions of the submerged void to be filled. The physical conditions may include one or more of the dimensions (e.g., length, width, depth, and volume) of the submerged void, how far below ground level the submerged void lies, what type of gas(es) and/or liquid(s) lie within the submerged void, the quantity of gas(es) and/or liquid(s) within the submerged void, the permeability of the submerged void, and the structural integrity of the submerged void, for example. The size of the submerged void is measured and/or calculated to determine the amount of fill material that will be used to fill the submerged void. For example, analyzing photography, using sonar equipment, and/or examining surveying records may determine the size of the submerged void. Further, a borehole may be drilled into the submerged void and the liquid(s) level and depth can be observed from the borehole. In some implementations, the borehole may be used as an injection hole during a feeding operation 725 (see below).

A determination operation 710 determines a desired maximum hole spacing for filling the submerged void. The determination operation 710 takes into account the physical conditions of the submerged void and the physical attributes of a foam-fluidized fill material to be used to fill the submerged void. Available fill constituent materials may be evaluated (e.g., for gradation properties, performance in underwater conditions, and cost). In addition, the selected solid fill material may be evaluated for amount or ratio of foam to be added to the solid fill material.

Several characteristics are relevant when determining the proper amount of foam to add to the solid fill material. One example characteristic is a desired foamed fill material pumpability or fluidity. The foam will create a fluid-like fill material mix without the addition of water (or very little added water) that will act fluid-like well enough to be pumped with a common grout pump. In other implementations, the foamed fill material will act fluid-like well enough to be placed by gravity (i.e., the foam/fill material will flow down an injection hole and continue to flow along the void floor beneath any liquid(s) within the submerged void).

In one example implementation, the desired amount or ratio of foam to be added to the fill material is determined by adding moisture to the fill material to make it moisture neutral (i.e., the fill material will not absorb moisture from added foam). The moistened fill material's density is calculated by filling a vessel with a known volume, adding foam to reach the desired fluidity, and then recalculating the foamed fill material's new density. The foamed fill material's new density may be heavier than the weight of the liquid within the submerged void.

The type as well as the amount of any fines (e.g., 200 mesh or less) added to the foam-fluidized fill material will influence the properties of the placed fill. The percent fines added may be determined by washing the desired blend of solid fill materials through a 200 mesh screen. For pumping applications, a 7 percent fines contribution often prevents sand packing of the pump. However, if the material is placed by gravity, less or none of the fines may be used. The potential fill material's grain size distribution may be determined by a gradation test. The added fine material may be adjusted to fit a desired application.

The resulting fill material may then be tested to determine consolidation within the submerged void. Consolidation of the fill material underwater is related to the amount of fines in the overall fill material mix. The more fines that are present, the softer the placed fill material will remain in the underwater environment. The placed fill material will require some level of in-place firmness in order to prevent future subsidence at the surface (using a bulking effect, for example). The bulking effect refers to the concept that a small void a reasonable distance from the surface will not have the potential for surface subsidence. For example, a 95% filled void typically allows the bulking effect to adequately reduce the potential for future surface subsidence.

Calculations estimate how far laterally the foam-fluidized fill material is expected to travel (e.g., by calculating the pressure that will be exerted by gravity and/or pumping pressure. The higher the pressure, the further the foam-fluidized fill material will travel horizontally within the submerged void. As a result, the injection holes may be spaced further apart. The maximum hole spacing is set to a quantity less than or equal to the expected lateral travel distance of the foam-fluidized fill material. In one implementation, a factor of safety is applied to the distance the foam-fluidized fill material is expected to travel to determine the maximum hole spacing.

In some implementations, a volume of foam-fluidized fill material estimated to fill the submerged void is determined. By determining the density of the fill material after placement, a known amount of material can be determined to fill the void. This will approximate the quantity of fill material anticipated to be used at each injection hole.

A drilling operation 715 drills holes spaced apart no more than the maximum hole spacing to access the submerged void. More specifically, the outside lateral dimensions of the submerged void are mapped out on a ground surface and drill points are marked on the ground surface. In one implementation, no distance between the individual marked drill points and the lateral extents of the submerged void exceeds the determined maximum hole spacing. Holes are drilled through the ground and into the submerged void at the marked drill points.

An insertion operation 720 inserts an injection tube into each of the drilled holes with a distal end of each of the injection tubes extending into the liquid(s) within the submerged void. In another implementation, insertion operation 720 utilizes less than all of the drilled holes at a time. Operations 700 are completed using selected holes and operations 700 are repeated with additional holes until all of the available holes have been utilized for filling the submerged void.

A feeding operation 725 feeds foam-fluidized fill material through the injection tubes and into the submerged void. In one implementation, a proximal end of each of the injection tubes is connected to a hopper. The hopper receives the foam-fluidized fill material and gravity-feeds the fill material into the injection tubes. In another implementation, a proximal end of each of the injection tubes is connected to a pump. The pump pressure feeds the fill material into the injection tubes. A combination or the gravity-fed and pressure-fed implementations may be used, as well as other ways of feeding the fill material into each of the injection tubes.

The vertical distance from the injection holes to the liquid surface within the submerged void may control whether the foam-fluidized fill material may be placed via gravity or pumped into the submerged void and how far the foam-fluidized fill material is expected to travel laterally within the submerged void. In one implementation, a depth of 100 feet has sufficient head pressure (e.g., approximately 2.1 feet of vertical distance will exert 1 psi of pressure) and velocity to move the fill material horizontally within the submerged void.

In another implementation where the distance from the ground surface to the liquid level within the submerged void is less than 100 feet (e.g., 50 psi may be the minimum for gravity placement), the foam-fluidized fill material may be pumped into the submerged void. The pumped material may utilize fines (e.g., 5-10% sub 200 mesh fines) to help maintain a pumpable fluid-like consistency in the foam-fluidized fill material. The fines may be cementious or non-cementious and work to prevent the pump from sand packing when pumping pressures are encountered. In one implementation, the pump type is a positive displacement piston pump. If pumping is not used (e.g., gravity placement), the overall gradation of the fill material may be fairly course with little to no fines.

Head pressure (or pumping pressure when a pump is used) creates energy that is transferred to the foam-fluidized fill material within the injection tubes. That energy pushes the foam-fluidized fill material horizontally at the distal end of the injection tubes. In some implementations, nozzles at distal ends of the injection tubes are used to direct the energy of the foam-fluidized fill material exiting the injection tubes. The fill material's ability to flow horizontally increases the maximum distance between injection holes to obtain a desired fill percentage of the void (calculated in operation 710).

The feeding operation 725 may be performed using all the drilled holes simultaneously, groups of holes at a time, or individual holes sequentially. Further, the feeding operation 725 forces fluid (liquids and/or gasses) within the submerged void upward through one or more of the drilled holes. A collecting operation 730 collects the fluid(s) discharged from the drilled holes. For example, the discharged fluids may be collected within a storage tank for later use or disposal. Further, the discharged liquids may be collected in an open reservoir or storage. In other implementations, collecting operation 730 is not used and the discharged fluids are vented to atmosphere or discarded onto the ground. Further, some of the drilled holes may be exclusively used for discharging fluids while other drilled holes are used exclusively for depositing the fill material. In other implementations, the drilled holes are useful for both discharging fluids and depositing fill material.

A monitoring operation 735 monitors pressure and/or flow rate of the fill material within the injection tubes. Further, the monitoring operation 735 may monitor the amount of foam-fluidized fill material placed through the drilled holes (e.g., by monitoring the weight of the fill material passing through the injection tubes). Monitoring operation 735 is used to determine the state of fill within the submerged void. Decision 740 determines if the fill material is discharging from one or more of the drilled holes. If so, this indicates that either the submerged void is filled at that location. As a result, ceasing operation 745 ceases the feeding operation 725, at least at the hole(s) in the vicinity of the discharging hole(s) and the void is re-evaluated. Re-evaluation of the filled void includes testing the structural integrity of the filled void and/or inspecting the state of fill within the void.

If no fill material is discharging from one or more of the drilled holes, decision 750 determines if the pressure and/or flow rate within the injection tube(s) is outside an operating range. In an example gravity-driven system, the operating range is any flow rate above a minimum flow rate. In an example pressure-driven system, the operating range is any pressure below a maximum pressure. Falling outside the operating range indicates that the fill material is no longer effectively flowing into the submerged void. If the pressure and/or flow rate within the injection tube(s) remains within the operating range, operation 735 and subsequent operations are repeated.

If the pressure and/or flow rate within the injection tube(s) falls outside the operating range, decision 755 determines if the distal end of the injection tube is still extending into the submerged void. If so, withdrawing operation 760 withdraws the injection tube(s) from the submerged void a predetermined incremental distance. This should reduce the pressure within the injection tube(s) and/or increase the flow rate of fill material through the injection tube(s). Operation 735 and subsequent operations are then repeated. If decision 755 determines that the distal end of the injection tube(s) are no longer extending into the submerged void (e.g., due to too many iterations of withdrawing operation 760), ceasing operation 745 ceases the feeding operation 725, at least at the hole(s) in the vicinity of the discharging hole(s) and re-evaluates the filled void.

In some implementations, a user calculates a total amount of fill material placed and compares that value to the original estimation. The total weight of the material placed combined with the average density of the fill material will yield the volume of the placed material. Further, the density and consolidation of the fill material may be verified after the foam has dissipated. A user may drill into the filled void where a sample is taken. In one implementation, a hollow metal tube (e.g., a California barrel sampler or a split spoon sampler) is driven into the fill material to produce an undisturbed core sample. Further, the load resistance is measured from the sample driving procedure. At the time of the verification drilling, any remaining void space between top of the void and the placed fill material may be measured and evaluated for its effect on the structural integrity of the filled void.

Utilizing operations 700 with a foam-fluidized fill material reduces or eliminates the cement, fly ash, or other fine solid material components of fines-fluidized fill material and does not require the large quantities of water of water-fluidized fill material. Further, the foam-fluidized fill material is less susceptible to segregation than fill materials with varying gradations of solid material components. Still further, the foam-fluidized fill material is capable of maintaining bearing capacity to support design vertical loads comparable or exceeding that of fines-fluidized fill material and water-fluidized fill material.

Some example benefits of the presently disclosed technology are as follows. The foam-fluidized fill material flows readily and has a reduced angle of repose when compared to traditional fill materials, even within a liquid. Therefore, the foam-fluidized fill material allows for increased distance between injection holes. Further, the foam-fluidized fill material may contain primarily one gradation of solid material and is thus less susceptible to segregation of constituent solid materials than traditional fill materials. Still further, the foam-fluidized fill material may be used to a variety of backfilling depths (e.g., greater than 100 feet). Further yet, the foamed fill material may utilize solid waste fill constituents. Further, the foam-fluidized fill material greatly reduces or eliminates 200 mesh (i.e., fine) material constituent components of the fill material (e.g., cement and/or fly ash) to make the fill material pumpable (as compared to fines-fluidized fill material).

Traditional fill material is often limited by its angle of repose within the submerged void. As a result, numerous injection holes are used to completely fill the submerged void. The foam-fluidized fill material has flow characteristics of a fluid and density heavier than the liquid within the void. As a result, the foam-fluidized fill material has a lower angle of repose than traditional fill materials and fewer injection holes may be used to fill completely the submerged void.

The foam replaces some or all of the fine solid material in a traditional dry pumpable fill material and/or water in a traditional hydraulically placed fill material. As a result, the majority of the fill material may be sand or other cheap aggregate that settles downward to a dense backfill as the foam moves upward through the fill material as it settles. Further, pumping the foamed fill material requires less energy to maintain suspension of particles in the fill material as compared to water-fluidized fill material. As a result, the foam-fluidized fill material may be pumped or gravity-fed with laminar flow as opposed to turbulent flow, which consumes less energy.

The embodiments of the invention described herein may be implemented as logical steps and are referred to variously as operations, steps, objects, or modules. Furthermore, it should be understood that logical operations may be performed in any order, adding or omitting one or more of the described logical operations, unless explicitly claimed otherwise or the claim language inherently necessitates a specific order.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A method for filling a subterranean void, the method comprising:

injecting a foam-fluidized granular fill material into the void and leaving the granular material in the void, the injecting being at an injection point beneath a surface of water within the void, wherein the foam-fluidized granular fill material is injected at a velocity sufficient for the foam-fluidized granular fill material to expand laterally within the void at least two times more than if the granular fill material was not foam-fluidized and to displace the water, and wherein foam within the foam-fluidized granular fill material dissipates, rather than being removed from the void, as the foam-fluidized granular fill material expands laterally within the void, thus self-compacting the granular fill material.

2. The method of claim 1, wherein the density of the foam-fluidized granular fill material is greater than the density of the water.

3. The method of claim 1, further comprising:

drilling a hole from a surface to access the void.

4. The method of claim 3, further comprising:

inserting an injection tube through the hole in the void, wherein a distal end of the injection tube extends beneath the surface of the water, and wherein the injection operation is performed using the injection tube.

5. The method of claim 4, further comprising:

monitoring pressure of the foam-fluidized granular fill material within the injection tube; and withdrawing the injection tube an incremental distance if the pressure rises above a predetermined maximum.

6. The method of claim 4, further comprising:

monitoring flow rate of the foam-fluidized granular fill material within the injection tube; and withdrawing the injection tube an incremental distance if the flow rate drops below a minimum flow rate.

7. The method of claim 1, further comprising:

collecting the water displaced by the injected foam-fluidized granular fill material.

8. The method of claim 1, wherein the foam-fluidized granular fill material is a homogeneous mixture of at least granular solid fill material, a surfactant, and air.

9. The method of claim 8, wherein the granular solid fill material is sand.

10. The method of claim 1, wherein the void contains a second liquid below the water, wherein the second liquid has a density greater than the water, and wherein the foam-fluidized granular fill material expands laterally between the water and the second liquid and displaces the water.

11. The method of claim 10, wherein the density of the foam-fluidized granular fill material is greater than the density of the water and less than the density of the second liquid.

12. The method of claim 1, wherein the foam-fluidized granular fill material becomes less fluid and more compacted as it expands laterally within the void.

13. The method of claim 1, wherein the injection operation is gravity-driven or pressure-driven.

14. The method of claim 1, wherein the foam-fluidized granular fill material expands laterally at least 2.5 times more than if the granular fill material was not foam-fluidized.

15. A method of filling a submerged void comprising:

drilling a hole from a surface to access the submerged void;

inserting an injection tube from the surface and through the hole, wherein a distal end of the injection tube extends beneath a surface of a liquid within the submerged void;

injecting a foam-fluidized granular fill material with a density greater than that of the liquid into the submerged void through the injection tube at a velocity sufficient for the foam-fluidized granular fill material to expand laterally at least two times more than if the granular fill material was not foam-fluidized and to displace the liquid, with the foam within the foam-fluidized granular fill material dissipating, rather than being removed from the void, as the foam-fluidized granular fill material expands laterally within the void, thus self-compacting the granular fill material; and leaving the self-compacted granular material in the void.

16. The method of claim 15, further comprising:

collecting the liquid displaced by the injected foam-fluidized granular fill material.

17. The method of claim 15, wherein the liquid is discharged from the void via the drilled hole.

18. A method comprising:

calculating a maximum hole spacing for filling a submerged void;

drilling two or more holes from a surface to access the submerged void, wherein the holes are spaced no further apart than the calculated maximum hole spacing;

inserting an injection tube from the surface and through each of the holes, wherein a distal end of each of the injection tubes extends beneath a surface of a liquid within the submerged void; and injecting a foam-fluidized granular fill material with a density greater than that of the liquid into the submerged void through the injection tubes at a velocity sufficient for the foam-fluidized granular fill material to expand laterally at least two times more than if the granular fill material was not foam-fluidized and to displace the liquid, with the foam within the foam-fluidized granular fill material dissipating, rather than being removed from the void, as the foam-fluidized granular fill material expands laterally within the void, thus self-compacting the granular fill material; and leaving the self-compacted granular material in the void.

19. The method of claim 18, further comprising:

collecting the liquid displaced by the injected foam-fluidized granular fill material.

20. The method of claim 18, wherein the liquid is discharged from the void via one or more of the drilled holes.

* * * * *